US005899174A

United States Patent [19]

Anderson et al.

[11] Patent Number: 5,899,174

[45] Date of Patent: May 4, 1999

[54] ENCLOSED ENGINE GENERATOR SET

[76] Inventors: Wayne A. Anderson, W6619 Esker Ridge, Elkhart Lake, Wis. 53020; Donald R. Fischer, N7329 North Star Rd.; James L. King, 408 North Ave., both of Sheboygan, Wis. 53083

[21] Appl. No.: 09/019,754

[22] Filed: Feb. 6, 1998

[51] Int. Cl.[6] ..... F02B 63/04

[52] U.S. Cl. ..... 123/2; 290/1 A; 290/1 B; 123/41.56

[58] Field of Search ..... 123/41.01, 41.56, 123/2; 290/1 A, 1 B; 310/52

[56] References Cited

U.S. PATENT DOCUMENTS

| | | | |
|---|---|---|---|
| 3,566,142 | 2/1971 | Dabell | 290/1 |
| 4,173,951 | 11/1979 | Ishihara | 123/2 |
| 4,243,893 | 1/1981 | Sten | 290/1 |
| 4,495,901 | 1/1985 | Nannini et al. | 123/2 |
| 4,548,164 | 10/1985 | Ylonen et al. | 123/2 |
| 4,589,379 | 5/1986 | Fujikawa et al. | 123/41.49 |
| 4,608,946 | 9/1986 | Tanaka et al. | 123/2 |
| 4,647,835 | 3/1987 | Fujikawa et al. | 322/1 |
| 4,677,940 | 7/1987 | Bracht et al. | 123/2 |
| 4,702,201 | 10/1987 | Odo et al. | 123/2 |
| 4,835,405 | 5/1989 | Vlancey et al. | 290/1 |
| 4,890,584 | 1/1990 | Tamba et al. | 123/41.7 |
| 4,907,546 | 3/1990 | Ishii et al. | 123/41.56 |
| 5,374,866 | 12/1994 | Gill et al. | 310/59 |
| 5,433,175 | 7/1995 | Hughes et al. | 123/2 |
| 5,515,816 | 5/1996 | Ball et al. | 123/41.7 |
| 5,624,589 | 4/1997 | Latvis et al. | 219/133 |
| 5,642,702 | 7/1997 | Kouchi et al. | 123/198 |

*Primary Examiner*—Noah P. Kamen
*Assistant Examiner*—Brian J. Hairston
*Attorney, Agent, or Firm*—Quarles & Brady LLP

[57] ABSTRACT

The engine generator set has an internal combustion engine and an alternator in a main compartment. Two separate cooling air streams independently cool the internal combustion engine and alternator. The independent air streams are then intermixed in the main compartment and used to cool the engine exhaust system and gases. Heat sensitive components are segregated from the heat generating components. Cooling air is drawn over the heat sensitive components maintaining them at nearly ambient temperature.

12 Claims, 3 Drawing Sheets

FIG. 2
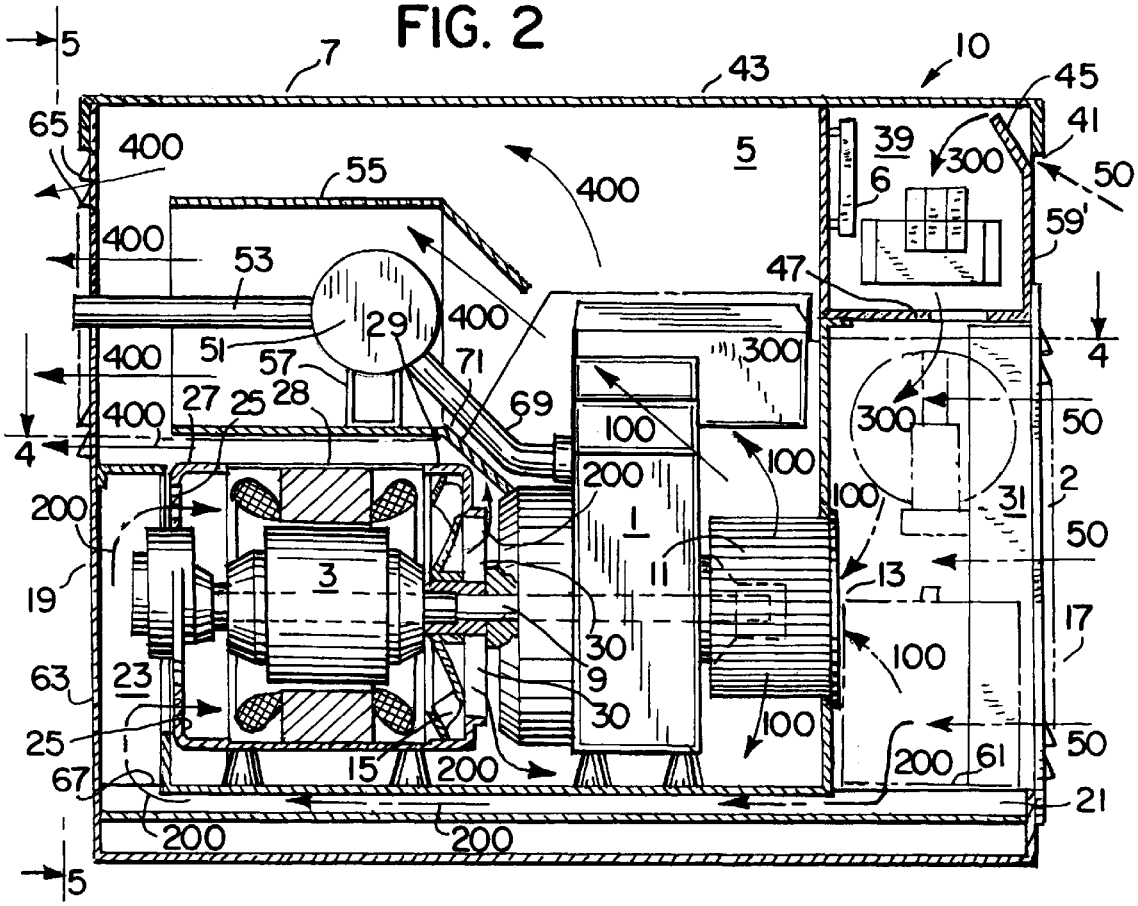
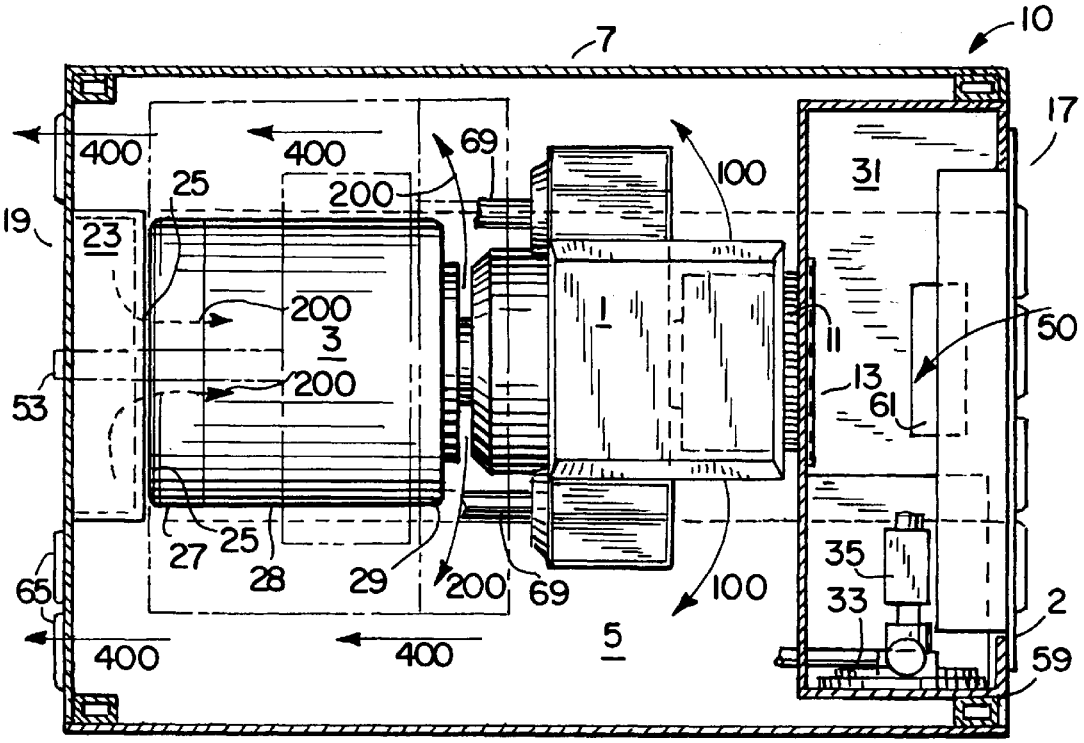
FIG. 4

FIG. 3
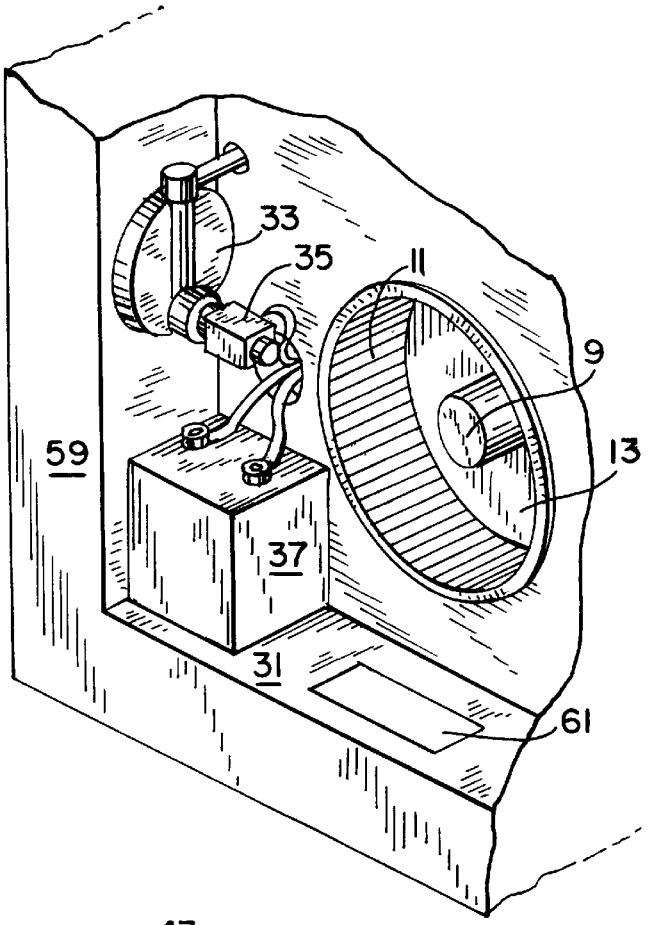
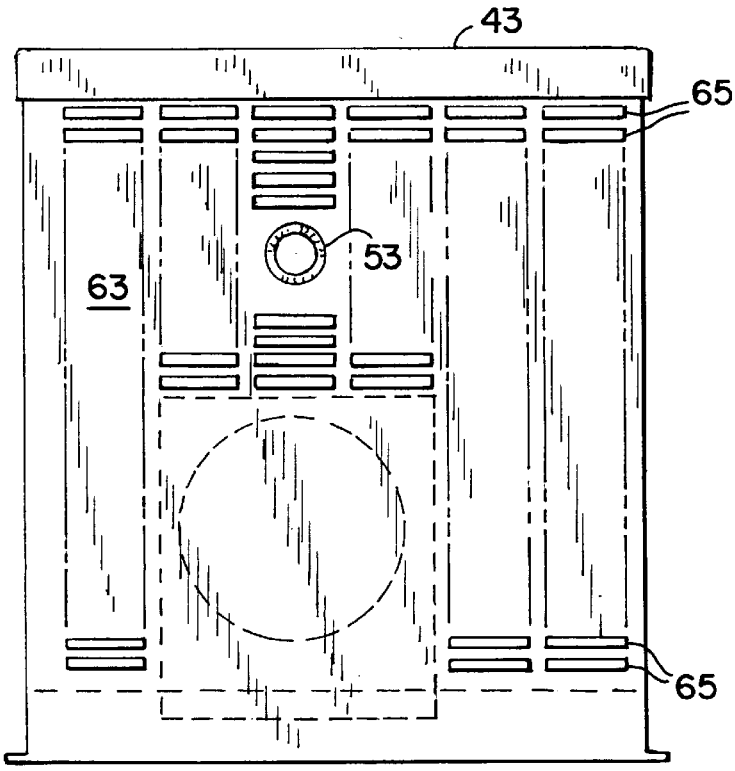
FIG. 5

ENCLOSED ENGINE GENERATOR SET

TECHNICAL FIELD

The field of invention is engine generator sets, more particularly an enclosed portable or small standby engine generator set configuration.

DESCRIPTION OF THE BACKGROUND ART

Engine generator sets are used in countless applications where a ready source of electrical power is either inconvenient or unavailable. These sets are often used at constructions sites or outdoors where adverse weather conditions are unpredictable or unavoidable. Engine generator sets are also often used as a backup electrical power source. In these types of conditions a loss of electrical power due to the failure of the engine generator set can result in a significant loss. Therefore, reliability of the components is extremely important.

A typical portable engine generator set consists primarily of a gas or diesel internal combustion engine that drives an alternator to generate electricity. Various electronic and mechanical controls necessary for operating the engine and regulating the electrical power generation are necessary components of a completely portable system.

A housing surrounding the engine generator set is often used to reduce the noise created by the operating system, protect users from coming into contact with heated parts, and protect the engine generator from adverse weather conditions. By enclosing the heat generating components, such as the internal combustion engine and alternator, with heat sensitive components, such as the starting battery and electrical controls, serious reliability issues arise.

In addition, using an air cooled engine for small enclosed standby engine generator sets is very cost effective compared to a liquid cooled engine. Using an air cooled engine, however, creates significant design issues related to purging the housing of the air rejected from an air cooled engine. Another significant design issue is to prevent the hot engine cooling air from recirculating back into the engine air intake and areas containing heat sensitive components.

Accordingly, it is desirable to have a cooling system for air cooled engine generator sets that provides cooling air paths that cool the hot components without heating the heat sensitive components of the engine generator set. Such a system is desirable when it does not increase the size or cost of the housing and further muffles the sound from the engine generator set.

U.S. Pat. No. 3,566,142 to Dabel issued Feb. 23, 1971; U.S. Pat. No. 4,243,893 to Sten issued Jan. 6, 1981; U.S. Pat. No. 4,495,901 to Nannini et al. issued Jan. 29, 1985; U.S. Pat. No. 4,608,946 to Tanaka issued Sep. 2, 1986; U.S. Pat. No. 4,647,835 to Fujikawa issued Mar. 3, 1987; U.S. Pat. No. 4,835,405 to Clanceu et al. issued May 30, 1989; U.S. Pat. No. 4,907,546 to Ishii et al. issued Mar. 13, 1990; U.S. Pat. No. 5,374,866 to Gill et al. issued Dec. 20, 1994; U.S. Pat. No. 5,515,816 to Ball et al. issued May 14, 1996; U.S. Pat. No. 5,624,589 to Latvis et al. issued Apr. 29, 1997; and U.S. Pat. No. 5,642,702 to Kouchi et al. issued Jul. 1, 1997 disclose countless different configurations and generators with enclosures and fans for drawing cooling air through the enclosure. The present invention provides solutions to these problems that are novel and advantageous over the prior art.

SUMMARY OF THE INVENTION

The present invention is an enclosure for an engine generator set with an improved cooling path that provides separate cooling air streams for the internal combustion engine and the alternator. Engine cooling air is drawn in to the enclosed engine generator set by an engine cooling fan driven by the engine. Alternator cooling air is drawn into the alternator by an alternator cooling fan also driven by the engine. A duct along the base of the engine generator set allows alternator cooling air to be drawn from the same end of the engine generator set as the engine cooling air. The duct maintains a separate cooling air supply that has not passed the internal combustion engine and experienced a rise in temperature caused by heat generated by the engine.

A general objective of the present invention is to separately cool the engine and alternator in an enclosed engine generator set. This is accomplished by providing a separate duct along the base to supply cooling air to the alternator which is drawn by a separate alternator cooling fan.

Another objective of the present invention is to protect heat sensitive components of an engine generator set. This is accomplished by placing the electronic and fuel controls in compartments separate from the internal combustion engine and alternator. Heat sensitive components are further protected by drawing cooling air through their compartments prior to the air coming into contact with the heat generating components.

A further objective of the present invention is to maintain flammable or explosive components present in an engine generator set at or near ambient temperature. This is accomplished by placing the starting battery and fuel controls in a primary air intake compartment. Ambient temperature cooling air is drawn through the primary air intake compartment by the engine cooling fan prior to the cooling air coming into contact with any heat generating components. Thus the primary air intake compartment and its contents maintain an ambient temperature.

A still further objective of the present invention is to provide a weather resistant enclosure that provides an improved air cooling path to heat generating components of an engine generator set. This is accomplished by having one air intake end and one air exhaust end. Air for cooling and combustion is drawn into the engine generator enclosure from the same end through a louvered grill and weather resistant slot. Cooling and engine exhaust air is expelled out of the engine generator set enclosure at an end different from the input end. The exhaust and cooling air exits the enclosure through a louvered grill.

Yet another objective is to maintain the internal combustion engine exhaust system of the engine generator set inside the enclosure. This is accomplished by surrounding the muffler of the engine exhaust system with a muffler heat shield that protects the components in the engine generator set enclosure from radiant heat. The muffler heat shield also directs cooling air over the muffler to convectively cool the muffler.

A further objective of the present invention is to combine cooling air with internal combustion exhaust gases in order to rapidly cool the exhaust gases. This is accomplished by directing the internal combustion engine exhaust gases out the exhaust end of the enclosure surrounded by cooling air exiting the enclosure parallel to the engine exhaust gases.

BRIEF DESCRIPTION OF THE DRAWINGS

FIG. 2 is a side view of the generator set of FIG. 1 with arrows showing air flow;

FIG. 3 is a partial perspective view of a primary air intake compartment which forms part of the generator set of FIG. 1;

FIG. 4 is a top view of the generator set of FIG. 1 showing air flow; and FIG. 5 is a rear elevation of the generator set of FIG. 1.

DETAILED DESCRIPTION OF THE PREFERRED EMBODIMENTS

Figure 1:
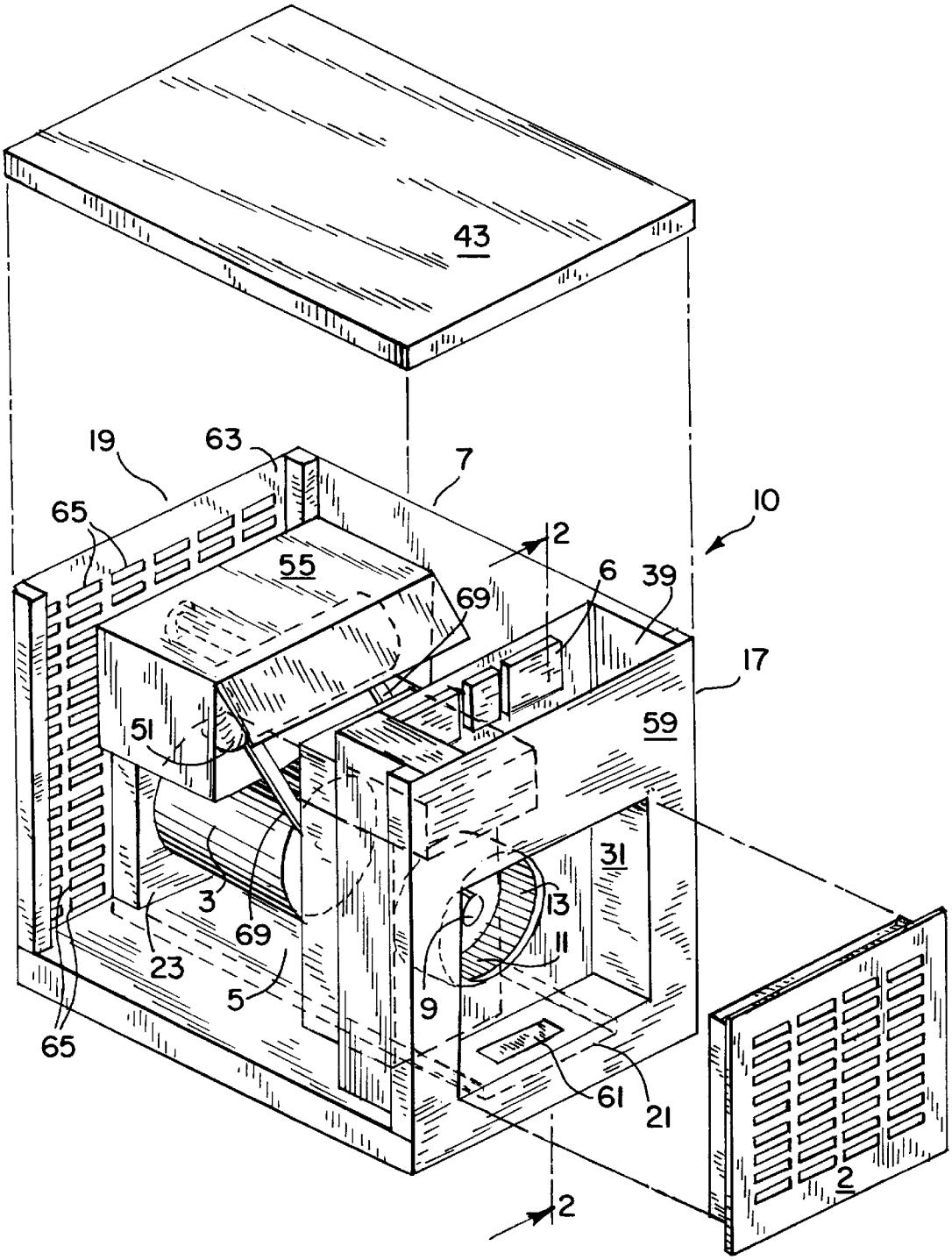
FIG. 1 is an exploded perspective view of the preferred embodiment of an enclosed generator set which employs the present invention with side panel removed and the roof panel and front grill detached.

Referring to FIGS. 1,2, and 4, the preferred embodiment of an engine generator set 10 includes an internal combustion engine 1 and an alternator 3 enclosed within a main compartment 5 of a housing 7. A primary intake compartment 31 inside housing 7 is located adjacent to main compartment 5. A second, electronic compartment 39 is also adjacent to main compartment 5 and disposed above primary air intake compartment 31 inside housing 7. A skid base 21 forms the bottom of housing 7.

In the preferred embodiment, internal combustion engine 1 is a two cylinder, horizontal shaft gasoline engine. Engine 1 is located at the inlet end 17 of main compartment 5 and alternator 3 is located at the outlet end 19 of main compartment 5. Internal combustion engine 1 and alternator 3 are fastened to a skid base using conventional fasteners.

Drive shaft 9 on internal combustion engine 1 drives alternator 3. Drive shaft 9 also drives an engine cooling fan 11 that draws ambient air 50 from the atmosphere through inlet 13 at the inlet end 17 of main compartment 5. Engine cooling fan 11 cools the internal combustion engine 1 by drawing engine cooling air 100 into the main compartment 5 through inlet 13 and then forces the air 100 past the internal combustion engine 1 and into the main compartment 5. Air flow is very important in this invention.

An alternator cooling fan 15 is also driven by drive shaft 9. Alternator cooling fan 15 is interposed between internal combustion engine 1 and alternator 3. Alternator cooling air 200 is drawn into alternator 3 by alternator cooling fan 15 through a skid base 21 and duct 23 that is open to apertures 25 in inlet end bracket 27 of alternator 3. Alternator cooling air 200 is drawn through alternator 3 from the alternator inlet end bracket 27 through the inside of alternator frame 28 to the alternator outlet end bracket 29. Alternator cooling fan 15 then forces the alternator cooling air through apertures 30 in the outlet end bracket 29 of alternator 3 and into main compartment 5.

Main compartment 5 acts as a plenum where cooling air from alternator cooling fan 15 and engine cooling fan 11 intermix. The intermixed cooling air 400 then exhausts out of outlet end panel 63 of housing 7. Outlet end panel 63 has louvered slots 65 that allow cooling air to pass through to the atmosphere.

As shown in FIG. 2, skid base 21 is used as a duct to direct ambient air 50 from the inlet end 17 of housing 7 to the outlet end 19 of skid base 21. The skid base 21 is a rectangular shaped duct that runs the length of housing 7. Skid base 21 is open at the inlet end 17 and has an outlet hole 67 at its other end that allows air 200 into to the vertical rectangular shaped duct 23 that is open to apertures 25 in inlet end bracket 27 of alternator 3. Alternator cooling air 200 enters skid base 21 through an intake 61 in the bottom of primary air intake compartment 31.

The cooling air passageway formed by skid base 21 and duct 23 guarantees cooling air 200 at very close to ambient temperature is supplied to alternator 3 because alternator cooling fan 15 supplies only alternator cooling air 200. The size of intake 61 and outlet hole 67 determines the quantity of alternator cooling air 200 that is supplied to alternator 3.

As shown in FIGS. 1 and 3, a starting battery 37, such as a 12 volt battery, is conveniently located on skid base 21 in the primary air intake compartment 31. Ambient air enters the primary air intake compartment 31 through a removable grill 2. Grill 2 is attached to the outside of housing 7 using conventional fasteners such as self tapping sheet metal screws.

Fuel supply controls, 33 and 35, for internal combustion engine 1 are also located in primary air intake compartment 31. The fuel control regulator 33 and electric shut off valve 35 are mounted to a wall of the primary air intake compartment 31. Removal of a few grill fasteners thus allows easy access to battery 37 and fuel supply controls, 33 and 35, for inspection and service. By locating the battery 37 and fuel supply controls, 33 and 35, in the primary air intake compartment 31, these potentially flammable or explosive components are maintained at close to ambient temperature.

The electronic control compartment 39 above the primary air intake compartment 31 contains alternator and internal combustion engine electronic controls 6. Electronic control compartment 39 is smaller than primary air intake compartment 31. Ambient air 50 is easily supplied through a simple weather resistant slot 41 located just beneath housing roof 43. An upward and inward projecting baffle 45 starting from the bottom of slot 41 acts as a rain, snow and dust shield.

The air slot 41 extends across the top of housing 7, for nearly the entire width of inlet end 17 of housing 7. The slot 41 and baffle 45 are formed by bending the sheet metal housing roof 43 downward 90 degrees and the top of the sheet metal inlet end panel 59 is bent inward at some angle greater than 0 degrees and less than 90 degrees to form a very simple and cost effective air intake baffle system. Preferably, the sheet metal inlet panel is bent inward 30 degrees.

Locating electronic compartment 39 directly above primary air intake compartment 31 simplifies providing a forced cool air supply for cooling the electronic components 6 contained within electronic compartment 39. One or more apertures 47 are strategically located in the bottom of electronic compartment 39 to allow ambient air 50 to be drawn in through the air intake slot 41, to exit through apertures 47 and to flow into the primary air intake compartment 31. The flow of cooling air 300 through electronic compartment 39 is controlled by the location and size of apertures 47.

It is very advantageous to have the internal combustion engine exhaust system inside main compartment 5 to avoid external hot surfaces that can cause burns to a user and to take advantage of the intermixed cooling air 400 that is flowing through main compartment 5. As shown in FIGS. 1,2, and 4, a pair of engine exhaust pipes 69 guide exhaust gases from internal combustion engine 1 into a single muffler 51. Muffler 51 is rigidly attached to engine exhaust pipes 69 and is disposed above the alternator 3. Hot exhaust gases exit muffler 51 through a muffler exhaust pipe 53. The muffler exhaust pipe 53 expels the hot exhaust gases into the atmosphere in a direction parallel to the intermixed cooling air 400 flow exiting housing 7 at the outlet end 19 of housing 7.

In order to protect the components that may be damaged by the heat from muffler 51, muffler 51 is surrounded by a muffler heat shield 55. Muffler heat shield 55 is a rectangular box that is open on opposite sides. The rectangular box is suspended from muffler 51 on light duty brackets 57 that provide a minimum of heat conduction. The muffler heat shield 51 is formed from sheet metal. Additional rigidity may be provided to the muffler heat shield 55 fastening of its edges to the top of duct 23.

As shown in FIG. 2, further heat shielding is provided by an engine exhaust pipe heat shield 71 positioned between the alternator 3 and the engine exhaust pipe 69. Engine exhaust pipe heat shield 71 is a rectangular piece of sheet metal rigidly mounted to and extending from the muffler heat shield 55 in a direction substantially parallel to the engine exhaust pipe 69. Engine exhaust pipe heat shield 71 may be welded to the end of muffler heat shield 55 or formed as an integral part thereof.

Muffler heat shield 55 and engine exhaust pipe shield 71 provide radiant heat shielding for alternator 3. In addition, muffler heat shield 55 channels intermixed cooling air 400 past muffler 55 as the cooling air 400 exits housing 7. Channeling cooling 400 air as it exits housing 7 provides conventional convective cooling to muffler 55 that significantly reduces the overall heat transferred to the inside of housing 7.

While there has been shown and described what is at present considered the preferred embodiment of the invention, it will be apparent to those skilled in the art that various changes and modifications can be made therein without departing from the scope of the invention defined by the appended claims.

We claim:

1. An internal combustion engine generator set comprising:

a housing having an inlet end, an outlet end, and a main compartment, said main compartment having an inlet at said inlet end of said housing;

an external cooling air passageway having an inlet and an outlet, said inlet of said passageway being at said inlet end of said housing, said outlet of said passageway exhausting cooling air into said main compartment at said housing outlet end;

an alternator mounted in said main compartment at said outlet end of said housing, said alternator having a rotatable shaft and frame supported by an inlet end bracket and an outlet end bracket; said brackets having apertures, said outlet of said passageway communicatively connected to said inlet end bracket of said alternator;

an alternator cooling fan mounted on said rotatable shaft, said alternator cooling fan interposed between said alternator and said internal combustion engine;

whereby said alternator cooling fan draws alternator cooling air into said passageway at said inlet end of said housing, through said passageway into said inlet end bracket and through said frame, and then expels said alternator cooling air into said main compartment of said housing;

an internal combustion engine mounted in said main compartment at said inlet end of said housing, said internal combustion engine having a drive shaft, said drive shaft having a first end and a second end, said first end of said drive shaft being coupled to rotate said shaft of said alternator; and an engine cooling fan mounted for rotation by said drive shaft and positioned adjacent to said inlet of said main compartment to draw engine cooling air through said inlet of said main compartment and force said engine cooling air past said internal combustion engine into said main compartment of said housing to mix with said alternator cooling air.

2. An engine generator set as in claim 1 further comprising:

a first compartment adjacent to said main compartment at said inlet end of said housing, said first compartment having apertures for communication with the atmosphere, said inlet of said main compartment being in communication with said first compartment, whereby said engine cooling fan draws engine cooling air through said apertures in said first compartment, and then through said inlet of said main compartment.

3. An internal combustion engine generator set comprising:

a housing having an inlet end, an outlet end, and a main compartment, said main compartment having an inlet at said inlet end of said housing;

a cooling air passageway having an inlet and an outlet, said inlet of said passageway being at said inlet end of said housing;

an alternator mounted in said main compartment at said outlet end of said housing, said alternator having a rotatable shaft and frame supported by an inlet end bracket and an outlet end bracket, said brackets having apertures, said outlet of said passageway communicatively connected to said inlet end bracket of said alternator;

an alternator cooling fan mounted on said rotatable shaft, said alternator cooling fan interposed between said alternator and said internal combustion engine;

whereby said alternator cooling fan draws alternator cooling air into said passageway at said inlet end of said housing, through said passageway into said inlet end bracket and through said frame, and then expels said alternator cooling air into said main compartment of said housing;

said internal combustion engine mounted in said main compartment at said inlet end of said housing, said internal combustion engine having a drive shaft, said drive shaft having a first end and a second end, said first end of said drive shaft being coupled to rotate said shaft of said alternator;

an engine cooling fan mounted for rotation by said drive shaft and positioned adjacent to said inlet of said main compartment to draw engine cooling air through said inlet of said main compartment and force said engine cooling air past said internal combustion engine into said main compartment of said housing to mix with said alternator cooling air;

a first compartment adjacent to said main compartment at said inlet end of said housing, said first compartment having apertures for communication with the atmosphere, said inlet of said main compartment being in communication with said first compartment, whereby said engine cooling fan draws engine cooling air through said apertures in said first compartment, and then through said inlet of said main compartment; and a second compartment adjacent to said main compartment and disposed above said first compartment at said inlet end of said housing, said second compartment having first apertures for communication with the atmosphere and second apertures for communicating with said first compartment, whereby said engine cooling fan draws engine cooling air through said first apertures in said second compartment.

4. An engine generator set as in claim 3 in which a starting battery and fuel supply controls are mounted in said first compartment.

5. An engine generator set as in claim 3 in which electronic controls are mounted in said second compartment.

6. An engine generator set as in claim 3 wherein said internal combustion engine has an exhaust system that expels engine exhaust to the atmosphere at said outlet end of said housing and means are provided to direct said intermixed cooling air over said exhaust system.

7. An engine generator set as in claim 6 wherein said exhaust system has an exhaust pipe, a muffler interconnected with said exhaust pipe and a muffler heat shield having a first open end and a second open end, said muffler heat shield substantially surrounding said muffler to shield said muffler from other components in said main compartment, and wherein a portion of said intermixed cooling air enters said first open end and then over said muffler and then out said second open end and into the atmosphere.

8. An engine generator set as in claim 7 wherein said muffler heat shield includes an exhaust pipe shield extending from said first open end of said muffler heat shield between said engine exhaust pipe and said alternator.

9. An engine generator set as in claim 3 wherein said second compartment has a slot at said inlet end of said housing.

10. An engine generator set as in claim 9 wherein said slot has a bottom and a baffle, said baffle extending inward and upward from said bottom of said slot.

11. An internal combustion engine generator set comprising:

a housing having an inlet end, an outlet end, and a main compartment, said main compartment having an inlet at said inlet end of said housing;

a cooling air passageway having an inlet and an outlet, said inlet of said passageway being at said inlet end of said housing;

an alternator mounted in said main compartment at said outlet end of said housing, said alternator having a rotatable shaft and frame supported by an inlet end bracket and an outlet end bracket, said brackets having apertures, said outlet of said passageway communicatively connected to said inlet end bracket of said alternator;

an alternator cooling fan mounted on said rotatable shaft, said alternator cooling fan interposed between said alternator and said internal combustion engine;

whereby said alternator cooling fan draws alternator cooling air into said passageway at said inlet end of said housing, through said passageway into said inlet end bracket and through said frame, and then expels said alternator cooling air into said main compartment of said housing;

said internal combustion engine mounted in said main compartment at said inlet end of said housing, said internal combustion engine having a drive shaft, said drive shaft having a first end and a second end, said first end of said drive shaft being coupled to rotate said shaft of said alternator;

an engine cooling fan mounted for rotation by said drive shaft and positioned adjacent to said inlet of said main compartment to draw engine cooling air through said inlet of said main compartment and force said engine cooling air past said internal combustion engine into said main compartment of said housing to mix with said alternator cooling air; and a first compartment adjacent to said main compartment at said inlet end of said housing, said first compartment having apertures for communication with the atmosphere, said inlet of said main compartment being in communication with said first compartment, whereby said engine cooling fan draws engine cooling air through said apertures in said first compartment, and then through said inlet of said main compartment, wherein said inlet of said passageway is communicatively connected to said first compartment.

12. An internal combustion engine generator set comprising:

a housing having an inlet end, an outlet end, and a main compartment, said main compartment having an inlet at said inlet end of said housing;

a cooling air passageway having an inlet and an outlet, said inlet of said passageway being at said inlet end of said housing, wherein said cooling air passageway is a skid base having an inlet and an outlet and a duct having an inlet and an outlet, said skid base being underneath said main compartment, said inlet of said skid base being at said inlet end of said housing, said inlet of said duct being communicatively connected to said outlet of said skid base;

whereby said inlet of said skid base is said inlet of said passageway and said outlet of said duct is said outlet of said passageway;

an alternator mounted in said main compartment at said outlet end of said housing, said alternator having a rotatable shaft and frame supported by an inlet end bracket and an outlet end bracket, said brackets having apertures, said outlet of said passageway communicatively connected to said inlet end bracket of said alternator;

an alternator cooling fan mounted on said rotatable shaft, said alternator cooling fan interposed between said alternator and said internal combustion engine;

whereby said alternator cooling fan draws alternator cooling air into said Passageway at said inlet end of said housing, through said passageway into said inlet end bracket and through said frame, and then expels said alternator cooling air into said main compartment of said housing;

said internal combustion engine mounted in said main compartment at said inlet end of said housing, said internal combustion engine having a drive shaft, said drive shaft having a first end and a second end, said first end of said drive shaft being coupled to rotate said shaft of said alternator; and an engine cooling fan mounted for rotation by said drive shaft and positioned adjacent to said inlet of said main compartment to draw engine cooling air through said inlet of said main compartment and force said engine cooling air past said internal combustion engine into said main compartment of said housing to mix with said alternator cooling air.

* * * * *